US007588069B2

(12) United States Patent
Munz et al.

(10) Patent No.: US 7,588,069 B2
(45) Date of Patent: Sep. 15, 2009

(54) METHOD FOR MANUFACTURING OPEN POROUS COMPONENTS OF METAL, PLASTIC OR CERAMIC WITH ORDERLY FOAM LATTICE STRUCTURE

(75) Inventors: Ulrich Munz, Würzburg (DE); Bernd Kuhs, Lingertstr, 21, D-79541 Lörrach (DE); Raimund Strub, Remlingen (DE)

(73) Assignees: Kurtz GmbH, Kreuzwertheim (DE); Laempe & Mossner GmbH, Schopfheim (DE); Bernd Kuhs, Lorrach (DE)

( * ) Notice: Subject to any disclaimer, the term of this patent is extended or adjusted under 35 U.S.C. 154(b) by 134 days.

(21) Appl. No.: 11/786,155

(22) Filed: Apr. 10, 2007

(65) Prior Publication Data

US 2007/0296106 A1 Dec. 27, 2007

(30) Foreign Application Priority Data

Apr. 10, 2006 (DE) ..... 10 2006 017 104

(51) Int. Cl.
*B22D 19/00* (2006.01)
*B22D 29/00* (2006.01)

(52) U.S. Cl. ..... 164/98; 164/132

(58) Field of Classification Search ..... 164/98–112
See application file for complete search history.

(56) References Cited

U.S. PATENT DOCUMENTS 4,945,814 A * 8/1990 Huet ..... 89/36.02
6,155,331 A 12/2000 Langer et al.
6,767,619 B2 7/2004 Owens
2008/0176092 A1* 7/2008 Owens ..... 428/542.8

FOREIGN PATENT DOCUMENTS

| | | | |
|---|---|---|---|
| EP | 0 849 018 | A1 | 6/1998 |
| EP | 1 174 200 | A2 | 1/2002 |
| EP | 1 808 241 | A1 | 7/2007 |
| EP | 1 844 881 | A3 | 11/2007 |
| WO | WO 0226419 | A1 | 4/2002 |

OTHER PUBLICATIONS

Lancaster Foundry Supply Company, Binder Systems, www.lancasterfoundrysupply.com/bindersys.htm), ESI Group, "Manufacturing of Sand Cores", http://www.esi-group.com/products/casting/Etips/e-tips/eTip24.pdf, Jan. 5, 2009, 5 pgs.

(Continued)

*Primary Examiner*—Kuang Lin
(74) *Attorney, Agent, or Firm*—Blakely, Sokoloff, Taylor & Zafman LLP

(57) ABSTRACT

The invention relates to a method for the manufacture of light open porous components of metal, metal alloys, plastic or ceramic of any geometry. Here, the component is produced through casting liquid material into a casting device (01), wherein a core stack (04) is mounted, cast and removed in a casting mold (03). The core stack (04) here is designed as a regular multi-dimensional core lattice (09) with defined core lattice planes (12), where each core lattice plane (12) is constructed of individual regular core bodies (10).

15 Claims, 3 Drawing Sheets

OTHER PUBLICATIONS

U. Recknagel, "The Shell Moulding Process: A German Innovations", 2007, 7 pgs.

"Sand Casting",file:///P:/EIGENE%20DATEIEN/Texte/Lokale%20Ajteb/KUZ-014..., Jan. 5, 2009, 9 pgs.

Y. Yamada et al., "Processing of Cellular Magnesium Materials", Advanced Engineering Materials 2000, 2, No. 4, XP-002439004, pp. 184-187.

Grote, et al., "Giesstechnische erste el lung offenporiger Metallschwämme mittels mineralischer Platzhalter", 2000, XP-002428114, pp. 415-418 and English abstract (1 page).

B. Wantzen, "Offenporiger Alurniniurnschaurnguss", 2007, XP009090673, 1 page and English translation (2 pages).

* cited by examiner

METHOD FOR MANUFACTURING OPEN POROUS COMPONENTS OF METAL, PLASTIC OR CERAMIC WITH ORDERLY FOAM LATTICE STRUCTURE

CROSS-REFERENCE TO RELATED APPLICATIONS

The present patent application claims priority from German Patent Application No. 10 2006 017 104.7, filed on Apr. 10, 2006.

BACKGROUND OF THE INVENTION

The invention relates to a method for manufacturing open porous light components of metal, metal alloys, plastic or ceramic of any geometry according to the teaching of claim 1.

For manufacturing components of high strength and stiffness with low densities, methods are known from the prior art where metals are foamed-up in the liquid state with suitable foaming agents, e.g. gases, to manufacture components with the above-mentioned characteristics. These known methods however have the disadvantage that through the injection of the gasses during the foaming-up process, bubbles develop which reach different, not clearly definable or foreseeable or desirable sizes. Thus, components are created by means of these methods which have mechanical properties that can only be assessed with difficulty. In addition, the bubbles penetrate up to the surface of the components and prevent the creation of a defined outer skin thickness, which would be necessary for a calculable structural function.

In addition, methods are known where inner casting molds of amorphous disorderly lattice structures are produced, which are cast in a casting device. With the help of these internal casting molds of connected individual balls, components with open or closed outer wall can be manufactured which have an amorphous undefined lattice structure in the interior, since the core stack used in the casting method is formed from an accumulation of disorderly inter-connected balls. In this case, too, a clear definition of the mechanical properties of the component is impossible because of the unpredictability of the disorderly lattice structure in the interior of the components.

The object of the invention is to propose a method which makes possible the manufacture of light components of metal, metal alloys, plastic or ceramic of any geometry, where, through a clearly defined inner lattice structure of the core stack, mechanical requirements such as density, stiffness or strength of the component are predictable, and, if required, a defined outer skin of desired thickness can be manufactured.

Under the general term "light and stiff" and/or "energy and sound-absorbent", such components can be employed wherever moving masses for example have to have corresponding characteristics such as in vehicle manufacture for road or rail, in aircraft manufacture or machine construction/kinematics. In addition, components produced in this way are particularly suitable also for heat exchangers of any type through the open porous and orderly foam lattice structure, since they separate two simply connected spheres from each other.

SUMMARY OF THE INVENTION

This object is solved through a method according to the teaching of claim 1.

According to the invention, when using the method for the manufacture of light open porous components of metal, metal alloys, plastic or ceramic of any geometry, the component is manufactured through casting liquid material into a casting device. To this end, a core stack is located in the casting mold of the casting device which is mounted, cast and de-cored. This core stack is designed as regular multi-dimensional core lattice with defined core lattice planes wherein each lattice plane is constructed of individual regular core bodies. This means that in the method a casting device known from the prior art can be used where, however, the inner casting mold as core stack differs in that it is constructed as regular orderly core lattice. Here, the core lattice consists of at least a core lattice plane, each of which is composed of individual regular core bodies. Shape, size and number of the core bodies as well as their distance determine the porosity and the mechanical characteristics of the components resulting from the method. A closed outer envelope of the components can be created in that the core stack has a certain distance from the outer wall of the casting mold which is then filled with the liquid material and forms the closed outer wall. The distance between the core stack and the outer wall of the casting mold in this case determines the thickness of the component outer wall. Thus, a macroscopic regular lattice structure of the material can be created with the help of the method so that the building element has a macroscopic framework structure and combines the framework-typical advantages, namely low density, high stiffness and high strength with the microscopic properties of the material. The application of the method thus serves for the manufacture of components having meta-material typical properties, i.e. the characteristic parameters of which are not only determined by the parameters of the source material but also by the defined macroscopic structure of the component.

In a particularly excellent embodiment, individual core lattice planes for the manufacture of the core lattice as ball-shaped, polygonal or other voluminous core bodies of a dimension that can be freely determined joined through ligaments are joined in two or several layers lattice-offset such that the core bodies previously slicked or provided with glue of the individual planes are in contact by means of binder or adhesive bridges. Thus, lattice planes defined through a core barrel tool are manufactured at first. A core lattice plane is characterized in that the ball-shaped polygonal or other voluminous individual bodies of freely determinable dimension are joined among one another with ligaments. The core bodies can thus have any shape and deviate from a classic ball shape, more preferably they can be flattened ball-shaped, polygonal or shaped in any other way. A lattice plane can consist of two or several bodies connected with one another and can be both flat plane as well as curved in a spherical plane or otherwise. Thus, a core stack is constructed of individual core lattice planes and can in this way fill the component layer by layer.

As a matter of principle, the method for manufacturing the individual core lattice planes can be performed in any way. It has proved to be particularly advantageous to shape the individual core lattice planes in a first operation through joining the core bodies into plates that are fixed planar, bent or curved in any way. Only by stacking the individual core lattice planes on top of one another, more preferably of the plates that constitute them, a desired shape of the core lattice is created. Through such a layer-by-layer construction it is advantageously possible to manufacture the core lattice independently and after the manufacture of the individual core lattice planes, more preferably it is conceivable to pre-fabricate core lattice planes, cut them in a desired shape if required and assemble them into a core lattice. This enables favorable, rational and quick manufacture of the core lattice from prefabricated core lattice planes, more preferably of prefabricated plates.

As a matter of principle, the individual core lattice planes can be manufactured in any way in a first operation. Going on from the embodiment sketched above however it is advantageous for adjacent core bodies to be joined through ligaments in a single molding method for manufacturing the core lattice planes. Through ligament connections a reliable fixation of the core bodies in the core lattice plane is achieved so that a planar or any curved shape of the core lattice plane can be sturdily manufactured.

After individual core lattice planes have been manufactured according to the embodiments shown above they have to be connected with one another to produce a core body. This can be performed in any way, this has proved to be particularly easy through joining the individual core lattice planes through a suitable binder and curing method as are already known in the creation of core bodies in foundry technology. In this way, treatment for example with hot air, with carbon dioxide or with an amine or merely a heat treatment through microwaves can be suitable for example to join the core lattice planes with one another. Many different foundry binders on organic and inorganic basis are available as binders which decompose through the heat effect of the hot metal, plastic or other castable material or they must be water-soluble so that they can be removed again from the component after the casting of the casting material.

The method for manufacture of the individual core lattice planes can be embodied in any way. The bodies within the core lattice structure however have a defined size, for example 10 mm and can be manufactured in a lattice network. Here, a suitable foundry core sand can be mixed with a known core sand binder for example and this core lattice plane base material formed and cured through a suitable core manufacturing method. To manufacture the individual core lattice planes it is particularly advantageous here that known betaset, coldbox, hotbox or croning methods with organic binder components are used. With these known methods for the manufacture of casting molds the core lattice planes can be manufactured cost-effectively and easily without special conversion of the casting process.

In the process it is particularly favorable if in the manufacture of the core lattice planes, water-soluble inorganic binder components based on magnesium sulphate, phosphate or silicate or a mixture of these are used. These inorganic binders are excellently suitable in a cost-effective and simple way to manufacture sturdy core lattice planes that can be assembled into complex core stacks.

The material which is used for constructing the individual core lattice planes can, as a matter of principle, be randomly selected from the range of the materials that are conventionally used for inner casting molds. However it has preferably shown that inorganic powder or sands, more preferably consisting of quartz, feldspar, aluminum oxide, refractory, olivine, chromium ore, clay, fluorspar, silicate or bentonite or a mixture of these, are suitable for the manufacture of core lattice planes. From these materials core bodies can be manufactured in a particularly easy way and combined with the above-mentioned core sand binders so that particularly durable and easily processable core lattice planes can be manufactured.

As an alternative to the above-mentioned materials it is however also possible that salts are used to manufacture the core lattice planes, more preferably sodium chloride (NaCl), potassium chloride (KCl), potassium sulphate ($K_2SO_4$) or magnesium sulphate ($Mg_2SO_4$). As an alternative to the minerals presented above the individual core lattice planes can be constructed of these salts.

Shape and size of the core bodies within the core lattice can always be selected as required. However, it has proved to be particularly advantageous if the core bodies have a size from 1 mm to 30 cm. More preferably it is particularly advantageous, if the core bodies have a diameter of approximately 5 mm to 20 mm.

Once individual core lattice planes have now been cured, they are coated with a binder or adhesive or slicked and stacked in two or several layers on top of one another so that the core bodies of the individual planes are in contact with one another in a lattice-offset manner. By means of the slicker/adhesive bridges that can be created the core bodies are joined to one another at the contact point/contact surfaces. This can always be performed in any way but it has proved to be particularly advantageous if the core lattice planes are manufactured in parts or in sets in a multi-part sandwich core barrel, wherein the core lattice planes are slicked in said barrel, assembled with one another and placed down in the core barrel.

Here, it has proved to be particularly preferable if in the manufacture of the core lattice planes the core lattice frames used are part of a tool, more preferably a robot-controlled tool, which are arranged within a core manufacturing tool and the smoothing, mounting and placing of the core lattice is performed outside the core manufacturing tool. This means that the individual core lattice planes are manufactured within a core manufacturing tool by means of a core lattice frame, preferably through a robot-controlled tool comprising the core lattice frame. Following this, the individual core lattice planes are taken from the core manufacturing tool and the slicking, assembling and placing down of the core lattice is performed outside the core-manufacturing tool.

To accelerate the manufacturing speed and effectiveness in the manufacture of the core lattice it has proved to be particularly advantageous if at least two robots work in a cycle, wherein a robot works in the core manufacturing tool for the core manufacture, while the second robot performs the smoothing, assembling and placing of the core lattice. As a result it is possible that a core lattice plane is simultaneously manufactured through a robot while outside the core manufacturing tool, a second robot assembles, slicks and places already manufactured core lattice planes. Thus, a maximum work effectiveness and productivity in the manufacture of the core stack is provided.

The core lattice stack manufactured thus can now in turn be mounted in a casting mold, e.g. a chill. Through the cavities between the core bodies of the individual core lattice layers and by way of the distance between the assembled core structures and the mold wall the later geometry and outer wall thickness of the cast part can be determined. Through a suitable casting method these cavities are in this way filled with metal, plastic, metal alloys or a ceramic mass. Preferably in filling with metal the entire core structure is heated, for instance in an oven, beforehand in order to guarantee the flow capability of the metal up to all fine intermediate spaces.

During the casting process it is advantageous here that the liquid material flows up to the level of the material sump in the mold via the static pressure and thereafter is drawn into the mold through a vacuum generated by a vacuum station until the mold is filled. Thus, the casting process is performed in two phases. The liquid material runs into the casting mold up to the level of the material sump, wherein the material sump is created through the inflow of liquid material from an oven. After the level of the liquid material has reached the level of the material sump within the casting mold through static pressure, a vacuum pump through a vacuum draws the material higher into the mold so that ultimately the entire mold is filled with liquid material.

Once the metal melt, the plastic or the ceramic mass has hardened, all core material can be removed from the component through vibration, blasting or washing with water. To this end, at least one side of the component is created without outer skin or the outer skin is subsequently reopened at a suitable point, e.g. drilled open, so that all core material can be removed without trace, since all core bodies contacted by way of the binder/slicker bridges are interconnected.

Because of this, components of defined outer skin, defined pore size and orderly foam lattice structure that can be repeated in the process can now be manufactured. This is not possible with the already known methods from the prior art.

BRIEF DESCRIPTION OF THE DRAWINGS

In the following, the method and the construction of a component produced from the method is explained in more detail by means of drawings.

It shows.

DETAILED DESCRIPTION OF THE INVENTION

Figure 1:
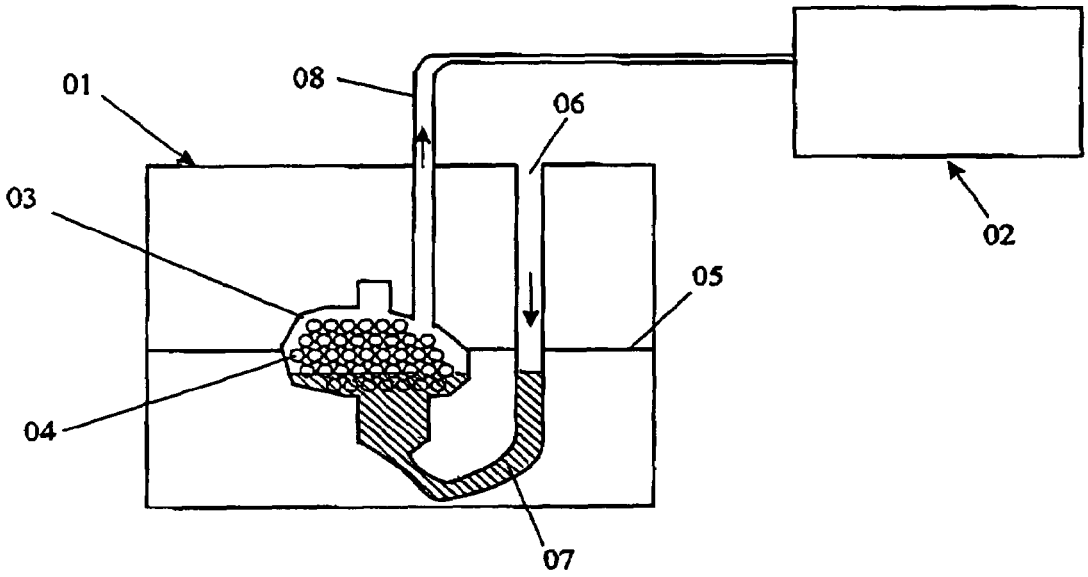
FIG. 1 in schematic view a casting device of the method according to the invention.

A casting device 01 is schematically shown in FIG. 1 in which a casting mold 03 is contained. In the casting mold 03, liquid material from an oven can be filled through a casting feed 06, wherein the liquid material forms a casting sump 07. Here, the liquid material flows into the casting mold 03 up to the level of the static pressure of the casting mold 07. The casting device 01 is constructed so that the casting mold 03 can be split at a splitting joint 05 in order to remove the cast component from the casting mold 03. In the interior of the casting mold 03 is located a core stack 04 which consists of individual core lattice planes which are assembled of individual core bodies and forms a regular core lattice. With the help of a vacuum station 02 a vacuum is created in the interior of the casting mold 03 through a vacuum discharge 06 so that the liquid material is drawn up within the core stack 04 in order to fill out the entire casting mold 03.

Figure 2:
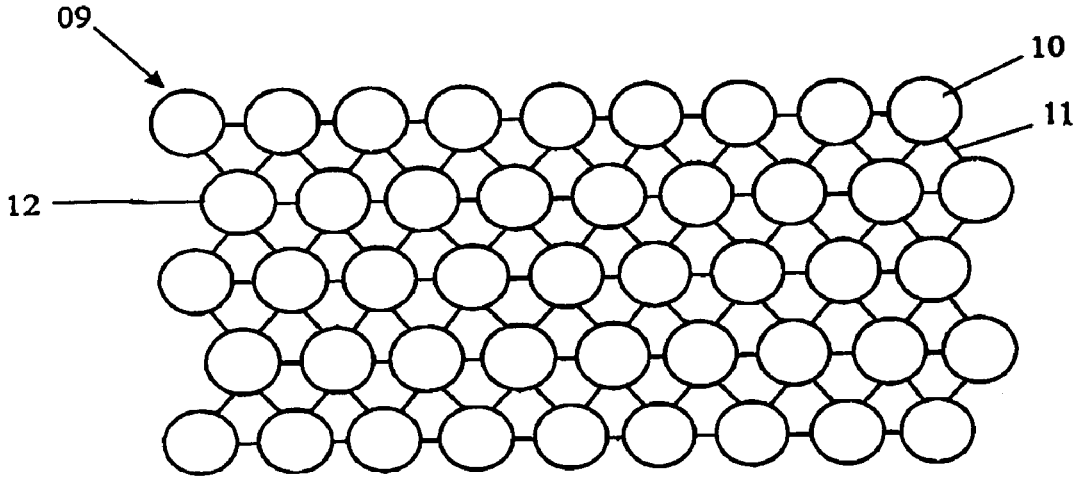
FIG. 2 in schematic sectional view the construction of a core stack.

FIG. 2 shows a schematic section through the core stack 03 of FIG. 1. The core stack 03 here consists of a core lattice 09 where the individual core bodies 10 in this case designed ball-shaped, are connected with one another through bridges 11. The bridges 11 of the individual core lattice planes 12 can be designed as ligaments and for example be produced through a betaset, coldbox, hotbox or croning method with organic binder components. The individual core lattice planes are then brought in contact with one another with the help of adhesives bridges through binder or adhesive bridges.

Figure 3:
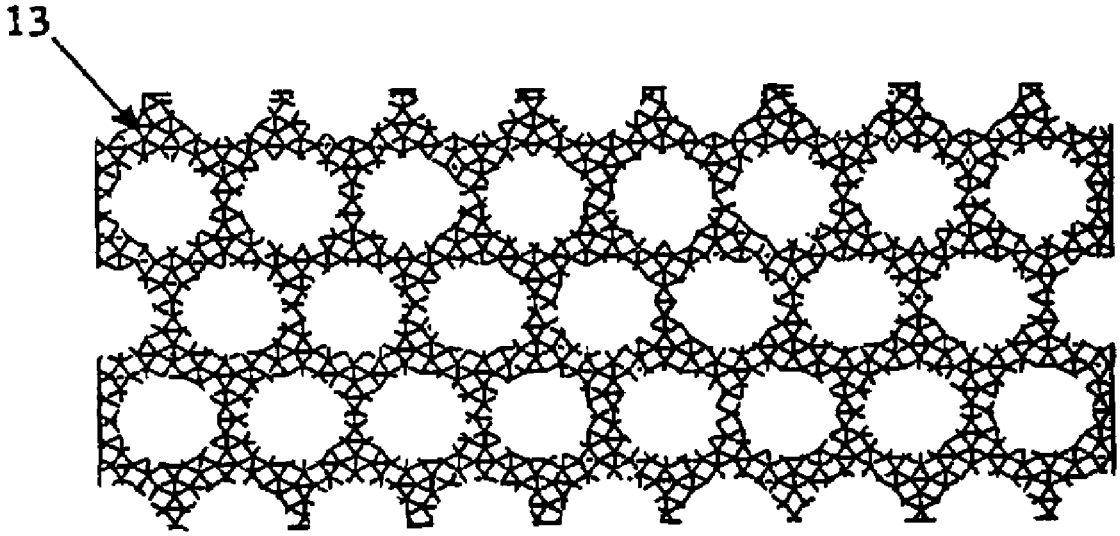
FIG. 3 in schematic view a section through a component obtained from the method according to the invention.

FIG. 3 shows a schematic section through a component 13 which is obtained through the pouring in of liquid material into the core stack 03 which consists of the core lattice 09. The filled-out material around the individual core bodies is clearly visible.

What is claimed:

1. A method for the manufacture of light open porous components of metal, metal alloys, plastic or ceramic of any geometry, wherein the component is manufactured through pouring liquid material into a casting device (01), comprising:

mounting a core stack (04) in a casting mold (03), casting the liquid material into the casting mold to form a composite article and removing the core stack (04) from the composite article to obtain a light open porous component, wherein the core stack (04) is designed as regular multi-dimensional core lattice (09) with defined core lattice planes (12), where each core lattice plane (12) is preconstructed of individual regular core bodies (10) joined through ligaments and the individual core lattice planes (12) are joined with one another in two or several layers, wherein the individual layers are displaced to each other by a lattice offset to form the core stack (04) so that the core bodies (10) previously slicked or provided with adhesive of the individual planes (12) contact one another by means of binder or adhesive bridges and the material used for manufacturing the core lattice planes (12) is an inorganic powder or sand.

2. The method according to claim 1, characterized in that the core bodies (10) which are ball-shaped, polygonal or otherwise voluminous of freely determinable dimensions.

3. The method according to claim 1, characterized in that for the manufacture of the core lattice the core bodies (10) are connected with one another in a first step in a core lattice plane (12) into fixed planar, bent or randomly curved plates and afterwards in a second step the individual core lattice planes (10), the plates, are stacked on top of one another to form the desired three-dimensional shape of the core lattice (09).

4. The method according to claim 3, characterized in that in the first operation for manufacturing the core lattice adjacent core bodies (10) are connected with one another through ligaments in a single molding method for the manufacture of the core lattice planes (12).

5. The method according to claim 2, characterized in that the connection of the individual core lattice planes (12) takes place through a suitable binder and curing method.

6. The method according to claim 1, characterized in that the core lattice planes (12) are produced through known betaset, coldbox, hotbox or croning methods with organic binder components.

7. The method according to claim 1, characterized in that the binder used for the manufacturing of the core lattice planes (12) comprises water-soluble inorganic binder components on the basis of magnesium sulphate, phosphates and silicates or a mixture of these.

8. The method according to claim 1, characterized in that the inorganic powder or sand, is quartz, feldspar, aluminum oxide, refractory, olivine, chromium ore, clay, kaolin, fluospar, silicate of bentonite, or a mixture of these.

9. The method according to claim 1, characterized in that the material used to manufacture the core lattice planes (12) is a salt, more preferably NaCl, KCl, $K_2SO_4$ or $MgSO_4$.

10. The method according to claim 1, characterized in that the core bodies (10) within the core lattice (09) have a diameter of 1 mm to 30 cm.

11. The method according to claim 9, characterized in that the core bodies (10) within the core lattice (09) have a diameter from 5 mm to 20 mm.

12. The method according to claim 1, characterized in that the core lattice planes (12) by parts or sets are manufactured in a multi-part sandwich core box, wherein the core lattice planes (12) are slicked, assembled with one another and placed in the core box.

13. The method according to claim 12, characterized in that the core lattice frames used for manufacturing the core lattice planes (12) are parts of a tool, preferably a robot-controlled tool, within a core manufacturing tool, and the smoothing, assembling and placing of the core lattice is performed outside the core manufacturing tool.

14. The method according to claim 13, characterized in that at least two robots work in cycle wherein a first robot works in the core manufacturing tool for the core manufacture while a second robot performs the smoothing, assembling and placing of the core lattice.

15. The method according to claim 1, characterized in that the liquid metal during the pouring process flows into the mold up to the level of the material sump via a static pressure and thereafter is drawn into the mold until it fills out the mold through a vacuum produced by a vacuum station (02).

* * * * *